United States Patent [19]

Bromboz

[11] Patent Number: 4,498,708

[45] Date of Patent: Feb. 12, 1985

[54] CONTINUOUS METHOD AND APPARATUS FOR MAKING A BRUSH

[76] Inventor: Jonathan J. Bromboz, 11 Chaparrel Ct., Novato, Calif. 94947

[21] Appl. No.: 455,282

[22] Filed: Jan. 3, 1983

[51] Int. Cl.[3] ..... A46D 1/08

[52] U.S. Cl. ..... 300/2; 264/243; 300/7; 300/21; 425/115

[58] Field of Search ..... 264/243, 261, 265, 174, 264/136; 425/112, 113, 115, 123, 505; 300/21, 2, 4, 5, 6, 7, 8, 9

[56] References Cited

U.S. PATENT DOCUMENTS

| | | | |
|---|---|---|---|
| 3,459,621 | 8/1969 | Kamenyarzh et al. | 425/113 X |
| 4,025,257 | 5/1977 | Sagane et al. | 425/115 |
| 4,325,900 | 4/1982 | Holding et al. | 264/174 X |
| 4,325,901 | 4/1982 | Holding et al. | 264/174 X |
| 4,325,902 | 4/1982 | Holding | 264/174 X |

FOREIGN PATENT DOCUMENTS

| | | | |
|---|---|---|---|
| 70151 | 6/1977 | Japan | 264/243 |

*Primary Examiner*—Mark Rosenbaum

*Attorney, Agent, or Firm*—Emrich & Dithmar

[57] ABSTRACT

A method for continuously making a brush-like material includes winding an adhering filament onto the outer surface of a flexible tubular member. The strands of wound filament and the tubular member are severed about the length of the tubular member to form a planar strip with filament segments adhering and extending across the width arranged in a spaced manner about the length of the planar strip. A portion of the planar strip is removed to expose the ends of the filament segments. The strips holding the filament segments are gathered and stacked in side by side relationship. The strips of filament segments and the exposed tips of segmented filament are immersed in a liquid anchoring material which is cured to secure the filament segments therein. The remaining strips of the tubular member are removed to form a finished strip of brush-like material.

24 Claims, 8 Drawing Figures

26a
26b
26c
26d
26e
26f
26g
26h
26i
26J
25
45
4
5
11
66
6
7
75
64
8
79
32
61
60
63

26
33

CONTINUOUS METHOD AND APPARATUS FOR MAKING A BRUSH

BACKGROUND OF THE INVENTION

The present invention relates to the art of brushes, and in particular, a method and apparatus for continuously manufacturing brushes and brush-like material.

In the past there have been three general categories of brush construction, namely, tufted, strip, and twisted in wire type brushes. In tufted brush construction, filament material is gathered into bundles or tufts which are fitted and secured in holes. Such construction is slow requiring the drilling of the holes. The tufts are difficult to handle and frequently clog up machinery and the like. Brushes formed by such construction generally have thick backs to hold the tufts. Bristle distribution is limited by the placement of the tufts on the backing surface.

In strip brush construction, the filament brush material is arranged in strips and clamped. Such construction generally requires a thick mounting for the clamp and other securing means. Strip brush construction further results in brushes which are limited to shapes which are adaptable to being clamped.

Brushes of twisted wire construction generally incorporate filaments within a twisted wire matrix. Such construction does not allow for the fine placement of the of the brush filaments and has found limited use.

My copending patent application soon to issue as U.S. Pat. No. 4,366,592 discloses a method of making brushes by forming a strip embodying a backing sheet with bristles disposed on one face in parallel relation to each other with edges projecting outwardly from one longitudinal edge of the strip. The strip is formed into a predetermined shape and the bristle ends are secured to a base allowing the removal of the backing sheet from the bristles to form a brush-like structure. Such brush-like material is adaptable to a broad range of commercial and industrial appplications. The density of the brush-like material is infinitely variable from a brush face so sparce that the bristles in the brush face can be counted, to a brush face that is so dense it is almost solid bristle. Widely differing length bristles can be accurately distributed within the same brush. Flat even brushes are possible without post trimming. The brush construction disclosed in the earlier application produces brushes that are substantially lighter than conventional brush type material and make more efficient utilization of the area securing the bristle material.

However, the earlier disclosure did not teach a method and apparatus particularly suitable for large scale commercial manufacturing. In particular, the earlier disclosure taught a method of manufacturing brushes which resulted in a brush like structure of circular or eliptical shape. Although the circular shape could be trimmed to an infinite variety of shapes, such trimming resulted in waste of a portion of the circular brush material. The previous teaching of a method for manufacturing brush-like material was not applicable to the felt need of producing a continuous strip of brush-like material which could be more readily incorporated in a variety of industrial applications.

SUMMARY OF THE INVENTION

The present invention provides a method and apparatus for the continuous manufacture of strips of brush-like material which can easily, and be efficiently grouped together to form a unitary brush-like mat or carpet.

Briefly, an embodiment of the present invention provides a method for continuously making brush-like material beginning with the steps of curling a continuous sheet to form a tubular member and winding an adhering filament onto the outer surface thereof. Strands of wound filament are then severed along a line extending axially the length of the tubular member to form filament segments. The tubular member is opened axially about its length along the line in which the strands of wound filament have been severed to form a planar strip with the filament segments adhering and extending across the width, arranged in a spaced manner about the length of the planar strip. A portion of the planar strip, extending along its length, is removed to expose the ends of the filament segments. The exposed tips of the filament segments are subjected to heat to produce a surface irregularity at the ends of the exposed filament segments. The planar strips holding the filament segments are gathered and stacked side by side and the exposed irregular tips of the filament segments are immersed in a liquid material. The liquid material is hardened to secure the irregularly shaped ends of the filament segments. The remaining planar strips, which the filament segments are adhered to, is removed to form a continuous strip of brush-like material with the filament segments projecting from the hardened liquid material.

A further embodiment of the present invention includes a method wherein the wound filament is severed axially along the length of the tubular member in a plurality of spaced positions about the circumference of the tubular member. The tubular member is opened axially about its length along the line of severed strands of wound filament with filament segments adhering thereto, in a plurality of positions to cooperate with the severed filaments. Thus, a plurality of planar strips are formed from a single winding operation which can be gathered and stacked side by side.

The present invention also includes a method in which liquid anchoring material is injected into a continuous rotating channel. The exposed irregularly shaped ends of the filament segments are received in the channel and immersed in the liquid anchoring material. As the channel rotates, the liquid anchoring material is hardened and removed from the channel. The channel continues to rotate to receive additional liquid anchoring material to complete a cycle. The hardened anchoring material securing the filament segments is removed from the channel as a continuous band. Removal of the remaining portion of the planar strip results in a continuous band of brush-like material. The brush-like material can be severed into predetermined lengths, arranged and secured in side by side configurations to form a brush-like mat or carpet.

A further embodiment of the present invention includes an apparatus for continuously forming strips of brushes. The apparatus includes conveying means for moving a sheet of material through various work stations. The first work station includes means for curling a sheet into a tubular member. The conveying means moves the tubular member to a ring of discharging spools of filament for winding filament about the tubular member, as the tubular member is propelled therethrough. A cutting station, in communication with the conveying means for receiving the wound tubular member includes means for cutting the filament and the tubular member into planar strips, and for selectively cutting and removing a portion of the planar strips or tubular member to expose portions of the segmented filament. The apparatus further provides means for receiving the planar strips holding the filament segments, and exposing the exposed tips of the filament segments to heat to produce ball shaped bristle ends. The conveying means carries the planar strips holding the filament segments to a work station for gathering and stacking the strips together and feeding the collected planar strips to a continuous rotatable channel. An injector is positioned about the surface of the channel for injecting a filament anchoring material within the hollow of the channel. The channel carrying the bristle embedding material receives the planar strips immersing the exposed ball shaped bristle ends into the anchoring material. The channel rotates as the anchoring material hardens to form a continuous band. Band removal means, in communication with the channel, removes the band and allows the U-shaped channel to rotate to receive additional liquid anchoring material to repeat the cycle. Strip removal means, in communication with the conveying means, removes the remaining strips of the sheet material from the embedded filament segments to form the a continuous band of brush-like material.

Further embodiments of the present invention provide means for segmenting the continuously formed band of brush-like material and means for gathering positioning and securing the segmented bands of brush-like material to form a larger mat. The mats can be formed of varying size to provide greater flexibility in the size and shape of brushes made according to the teaching of the present invention and my copending application.

Other features and advantages of the present invention will be apparent from the following description and claims and are illustrated in the accompanying drawings, which by way of illustration show a preferred embodiment of the present invention and the principles thereof and what is now considered to be the best mode in which to apply these principles. Other embodiments of the invention employing the same or equivalent principles may be used and structural changes may be made as desired to those skilled in the art without departing from the present invention and the purview of the appended claims.

DETAILED DESCRIPTION OF THE DRAWINGS

The present invention will be described in detail as a method and apparatus for manufacturing continuous bands of brush-like material and assembling the band of brush-like material into larger mats, with the understanding that the present disclosure is to be considered an exemplification of the principles of the invention and is not intended to limit the embodiment illustrated. For example, the present invention has application in the manufacture of carpet like materials, hook and loop attachment surfaces, presently marketed under the tradename VELCRO, artificial turf surfaces and the like.

Figure 1:
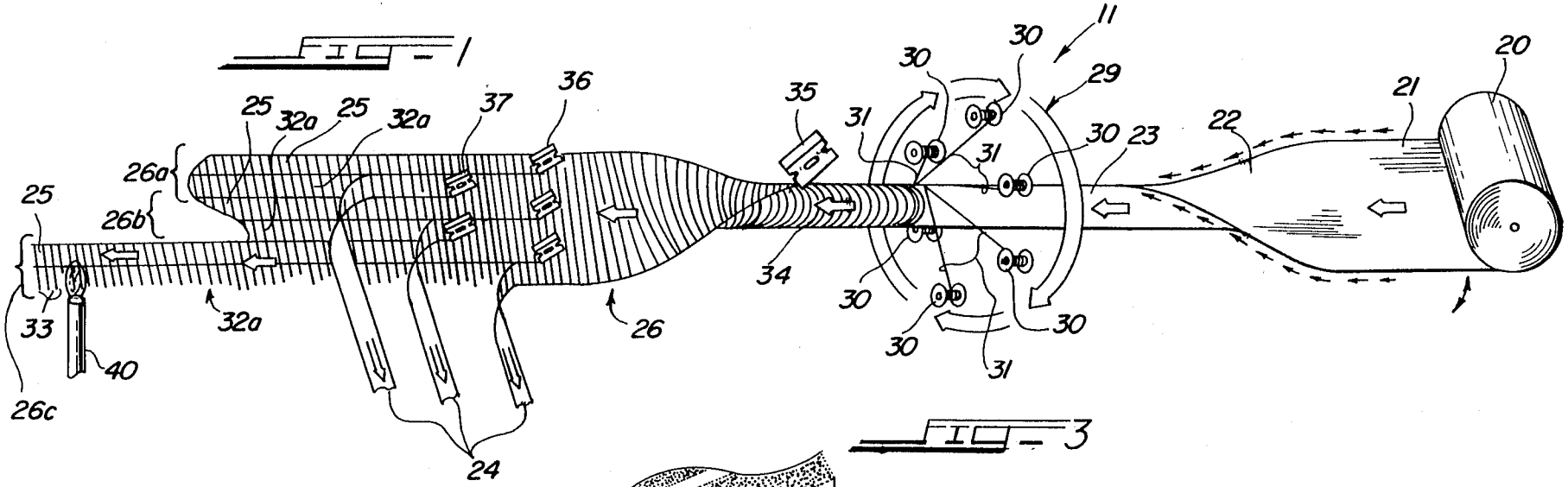
FIG. 1 is a side perspective view of an apparatus and method embodying principles of the present invention.
Figure 3:
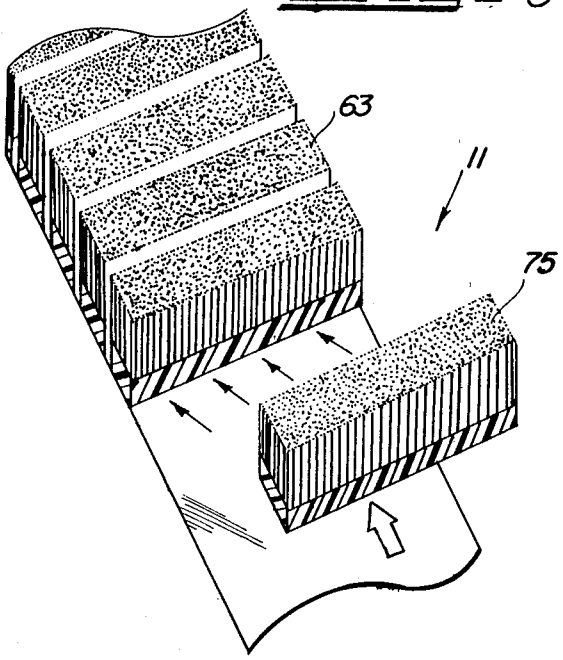
FIG. 3 is a side elevational view of a mat of brush-like material being formed according to the teaching of the present invention.
Figures 2, 4, 5, 6, 7, 8:
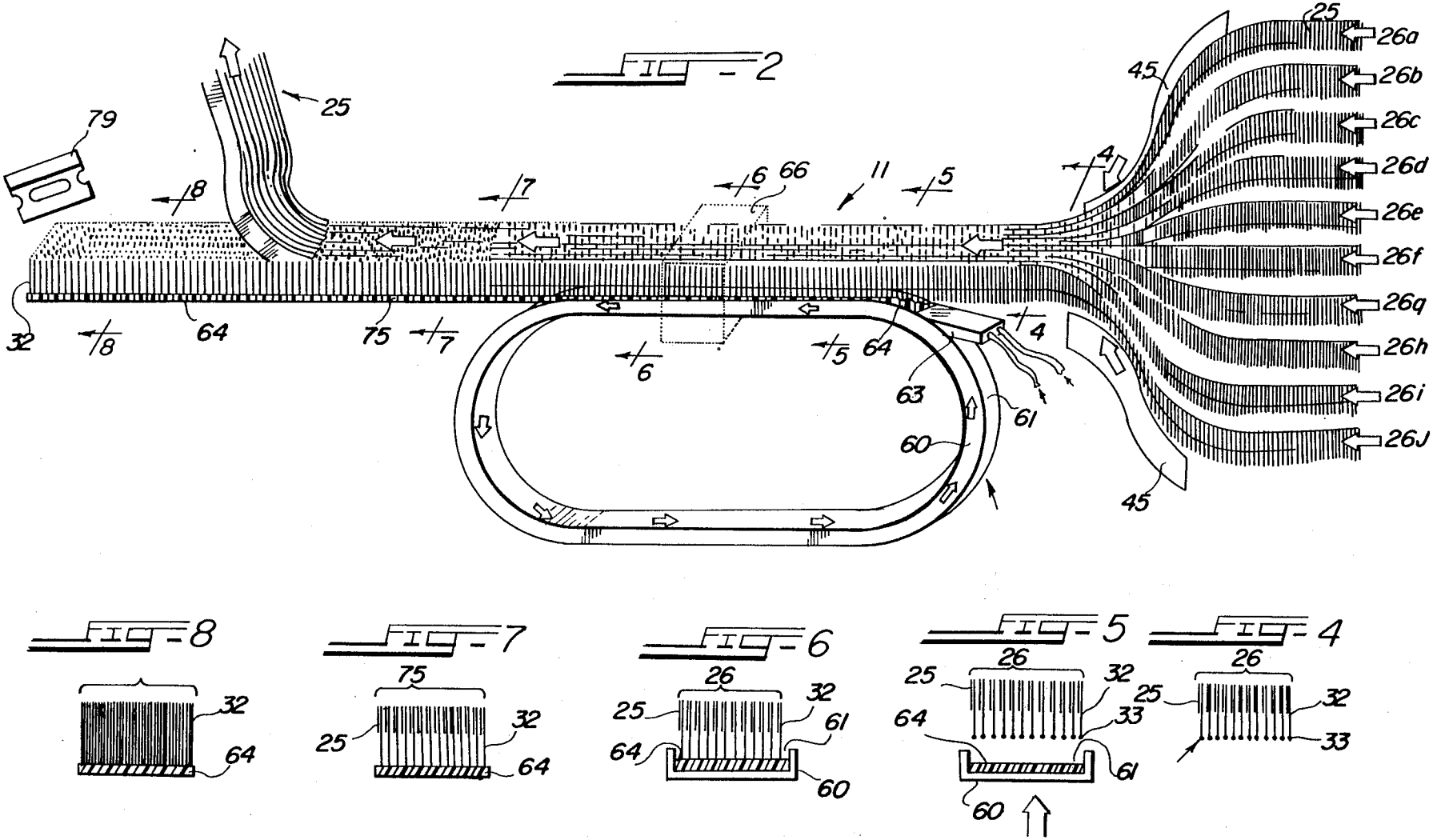
FIG. 2 is a side perspective view of an apparatus and method embodying principles of the present invention to follow sequentially with FIG. 1.
FIG. 4 is a cross sectional view of gathered and stacked planar strips with filament segments adhered onto the surface thereof as viewed substantially along line 4—4 of FIG. 2.
FIG. 5 is a cross sectional view of the planar strips holding segmented filaments impinging upon a rotating channel in which liquid anchoring material has been deposited.
FIG. 6 is a cross sectional view of the planar strips holding filament segments which are embedded in the liquid anchoring material within the channel as viewed substantially along line 6—6 in FIG. 2.
FIG. 7 is a cross sectional view of the planar strips holding filament segments in which the filament segments are embedded in hardened anchoring material and in which the channel has rotated to separate and remove the anchoring material as viewed substantially along line 7—7 in FIG. 2.
FIG. 8 is a cross sectional view of the band of hardened plastic material and segmented filaments embedded therein in which the remaining planar strip of sheet material has been removed as viewed substantially along line 8—8 in FIG. 2.

The method and apparatus for manufacturing brush-like material is illustrated sequentially in FIGS. 1, 2 and 3. The apparatus for making brush-like material is generally designated by the numeral 11. Referring now specifically to FIG. 1, sheet like material 21 is unrolled from roll 20 and carried on a conveyor (not shown) in a laterally right to left direction. The conveyor can take many forms, such as endless belts or rollers. The sheet like material 21 is curled and formed into a tubular member 23. The tubular member 23, although illustrated as a cylinder having a circular cross-sectional shape, may take any number of forms.

The tubular member 23 continues its movement towards and through a rotating ring 29 to which are mounted spools 30 of filament 31. The filament 31 of each spool 30 is affixed to the outer surface of the tubular member 23 such that rotation of the ring 29 causes the filament 31 to spin off the spools 30 and wind about the tubular member 23 in a spaced manner. The spacing of the filament 31 can be governed by controlling the speed of rotation of the rotating ring 29, the speed at which the tubular member 23 is conveyed through the ring 29 or the number and placement of the spools. It will be recognized in the art that a single spool 30 of filament 31 can be used instead of the plurality of spools 30 illustrated. A ring 29 holding a single spool of filament would necessarily have higher rotational speed to obtain the same spacing of filament about the tubular member 23 and would also require more frequent changing of the spool 30 as the filament 31 was depleted.

Preferably, the sheeting material 21 includes a tacky adhesive substance upon the side forming the outer surface of the tabular member 23. Filament 31 wound upon tubular member 23 releasably adheres to the outer surface of the sheeting material 21 for purposes that will be more fully described subsequently. However, the wound filament may be releasably secured to the tubular member by other means such as having an adhesive substance sprayed upon the tubular member 23 and the filament 31 after or before winding, or incorporating an adhesive substance on the surface of the filament 31.

The tubular member 23 would with filament 31 is further conveyed to a cutting station 34 where strands of wound filament 31 are severed by cutting means 35 along a line extending axially the length of the tubular member 23 to form filament segments 32. The tubular member 23 is cut or opened axially about its length along the line in which the strands of wound filament 31 have been severed to form a planar strip 26. Filament segments 32 are adhesively held in a spaced manner about the length, extending across the width of the planar strip 26. Portions of the planar strip 26 are cut by a second cutting means 36 without severing the underlying filaments 32. A third cutting means depicted by razor 37 severes not only the planar strip 26, but also the underlying filament segments 32 resulting in a plurality of smaller planar strips 26A–C. The lower portion 24 of each planar strip 26A–C is removed to expose portions of the filament segments 32. The filament segments 32 remain adhered to the upper portion 25 of each planar strip 26A–C. The lower portion 24 of each planar strip 26A–C is carried off to be discarded or recycled by realigning the lower portions 24 in the shape of the tubular member 23. It is within purview of the present invention to incorporate endless belts for each planar strip 26A–C.

Although the tubular member 23 depicted in FIG. 1 is cut and opened to form three planar strips 26A–C, it will be recognized that tubular member 23 can be cut and opened from one to any number of times. A larger number of strips 26 contributes to greater efficiency. It will also be recognized that the various cutting steps are interchangable in sequence or could be consolidated but have been described in the manner above to facilitate a greater understanding of the present invention.

Each planar strip 26A–C is conveyed to a heat device 40 which subjects the tips of the exposed portions 32A of the filament segments 32 to heat to produce anchoring balls 33 or other surface irregularities at the ends of the exposed filament segments. The anchoring balls 33 of the exposed ends 32A of the filament segments 32 extending downward with the remaining strip of sheet material 25 extending upward as can be seen in the cross sectional view illustrated in FIG. 4. It will be recognized that surface irregularities which can serve as anchoring means can be created in the tips of the exposed portions 32A by other means such as chemicals, crimping, and passing the exposed ends 32A over a hot nonstick surface to fuse the ends into a chain like structure, and the like. The exposed tips 32A may also be coated with an adhesion promoter, such as cyanoacrylate to increase the adhesion to anchoring material 64 to be described in detail later.

Now turning to FIG. 2, a plurality of planar strips 26A–J are received, gathered, and stacked side by side, spaced from each other by a predetermined distance set by either the thickness of the remaining upper portion 25 of strip 26 of sheet material or other spacing means.

The planar strips 26A–J are gathered by guides 45 and stacked side by side in a spaced relationship as depicted in FIG. 4 and then fed to a continuous rotating channel 60. The U-shaped channel 60 defines a hollow 61. As illustrated in FIGS. 2 and 5, an injector or dispensing head 63 deposits a liquid anchoring material 64 into the hollow 61 at a point prior to where the rotating channel 60 impinges upon the planar strips 26A–J. Turning now to FIGS. 2 and 6, the anchoring balls 33 of the exposed portion 32A of the filament segments 32 are immersed in the liquid anchoring material 64 which hardens or cures to secure each individual filament segment 32. A curing station 66 in communication with the rotating channel 60 facilitates the curing of the anchoring material 64 by chemical, heat, radiation or other means.

Although the term hardened has been used to describe the liquid anchoring material 64 after curing, this is not to imply that the cured anchoring material 64 must be rigid. It is considered within the purview of the present invention to utilize any liquid anchoring material which when cured will secure the individual filament segments 32, including without limitation semirigid materials such as rubber and soft plastics. Filament segments 32 and anchoring material 64 form a band 75, illustrated in FIG. 2 and in cross section in FIG. 7, which is removed from the hollow 61 of the channel 60 as the channel 60 rotates and diverges from the linear path of the hardened anchoring material 64. If a pliable cured anchoring material is utilized, band removing means in the form of scrapers (not shown) may be used. Preferably the hollow 61 of channel 60 has a nonsticky nonadhering surface such as surfaces treated with tetraflourohydrocarbons marketed under the trademark TEFLON.

It will also be recognized that the channel 60 may form an integral portion of the finished band 75 of brush-like material if a continuous channel is utilized in place of the rotating channel 60. Similarly, articles of manufacture, such a toothbrushes may be formed simultaneously with the formation of the finished band 75 by forming the brushes of the hardening material 64.

The remaining upper strip 25 of sheet material 21 is removed from the embedded filament segments 32 to form a band 75 of brush-like material as depicted in the cross sectional view of FIG. 8. The remaining upper strip 25 may be discarded, recycled, or returned to the first station to be reassembled with other upper or lower strip portions 24 and 25 in the manner of endless belts to form a new sheet like material 21.

Referring now to FIGS. 1 and 2, it can be readily seen that by merely affixing additional sheet material 21 to the depleted roll 20 and by securing additional filament 31 to depleted filament on spools 30, a continuous band 75 of brush-like material is formed by the present invention. The band of brush-like material 75 can be readily segmented into predetermined sizes and shapes for a variety of purposes or assembled into larger mats or carpets. Thus, band 75 of brush-like material is segmented by cutting means 79 and gathered and assembled to form larger mats 63 of infinite variety size and shape as best seen in FIG. 3.

Having thus disclosed preferred embodiments of the invention, persons skilled in the art will be able to modify certain of the structure which has been disclosed and to substitute equivalent elements for those described while continuing to practice the principles of the invention; and, it is therefore, intended that all such modifications and substitutions be covered and embraced within the spirit and scope of the appended claims.

I claim:

1. A method for continuously making a brush-like material comprising:

winding and adhering filament onto the outer surface of a tubular member;

opening said tubular member axially about its length with said filament adhering thereto to form a strip, said filament extending across the width arranged in a spaced manner about the length of said strip;

severing said strip to form strands of filament segments along a line extending axially the length of said strip;

exposing an end section of said filament segments;

gathering a plurality of said strips holding said filament segments and stacking said strips side by side in a spaced manner;

immersing portions of said exposed section of said filament segments in liquid anchoring material;

curing said liquid material to secure said filament segments; and, removing remaining strips from embedded filament segments to form a finished band of brush-like material.

2. The method of claim 1 further comprising the steps of segmenting said band of brush-like material into predetermined lengths and securing said bands in side by side configuration to form mats of brush-like material.

3. The method of claim 1 wherein anchoring means are formed at the exposed end sections of said filament segments prior to the immersion of said ends in liquid anchoring material.

4. The method of claim 3 wherein said anchoring means is formed by subjecting said exposed end sections of said filament segments to heat to produce ball-shaped bristled tips.

5. The method of claim 3 wherein said anchoring means is formed by passing said exposed end sections over a hot nonsticking surface to fuse said end section together into a chain like structure.

6. The method of claim 1 wherein said end section of said filament segments is exposed by removing a portion of said strip.

7. The method of claim 1 wherein said wound filament is severed axially along the length of said tubular member in a plurality of spaced positions about the circumference of said tubular member; and, said tubular member is opened axially about its length with said filaments adhereing thereto in a plurality of positions to cooperate with said severed filaments to form a plurality of strips.

8. The method of claim 1 wherein said exposed sections of said filament segments are covered with an adhesion promoter prior to immersion in said liquid anchoring material.

9. The method of claim 1 further comprising:

injecting liquid material into a continuous rotating channel wherein said portions of said exposed sections of said filament segments are immersed.

10. The method of claim 9 further comprising rotating said channel, and exposed filament segments to a curing means to facilitate curing of said liquid material.

11. The method of claim 9 further comprising:

removing said cured anchoring material with filament segments embedded therein from said channel; and, rotating said U-shaped channels to receive additional liquid anchoring material to repeat the cycle.

12. The method of claim 1 further including the additional step of curling a sheet of material to form said tubular member.

13. An apparatus for continually forming strips of brushes comprising:

conveying means for moving a tubular member and its winding means in communication with said conveying means for receiving said tubular member and winding and adhering filament about its outer surface in a spaced manner, cutting means in communication with said conveying means for receiving said tubular member and wound filament, and cutting said filament into segments;

removal means in communication with said conveying means for receiving said tubular member and filament for selectively removing a portion of said tubular member to expose end portions of filament segments;

gathering and stacking means in communication with said conveying means for receiving said strips for gathering and stacking said strips together;

channel means defining a hollow surface in communication with said conveying means for receiving said stacked and gathered strips;

injecting means positioned about said channel for depositing a liquid anchoring material upon the hollow surface of said channel means, said channel means receiving and immersing said exposed portions of said filament segments into the liquid anchoring material, said anchoring material curing to secure said filament segments;

second removal means in communication with said conveying means for removing remaining strips of tubular member from embedded filament segments in communication with said U-shaped channel to form finished strip of brush.

14. The apparatus of claim 13 further comprising:

curling means for curling a sheet of material into a tubular member, said conveying means in communication with said curling means to receive and convey said tubular member.

15. The apparatus of claim 13 wherein said winding means includes a rotatable ring and at least one spool of filament, said rotatable ring encircling the path of said tubular member as it is conveyed by said conveying means said spool rotatably mounted on said ring to discharge and wind filament on said tubular member as said ring rotates.

16. The apparatus of claim 15 further comprising a plurality of spools, said spools spaced about the circumference of said ring.

17. The apparatus of claim 13 wherein said channel means includes a continuous rotatable channel, said channel rotating to receive liquid anchoring material and said strips discharging said anchoring material and filament segments upon the curing of said anchoring material and rotating to receive additional liquid anchoring material and strips to repeat the cycle.

18. The apparatus of claim 17 further comprising:

curing means in communication with said rotatable channel to facilitate the curing of said liquid anchoring material.

19. The apparatus of claim 17 wherein said hollow surface of said rotatable channel further comprises a non-sticking surface to facilitate the removal of the cured anchoring material.

20. The apparatus of claim 13 further comprising:

anchor forming means in communication with said conveying means for receiving said tubular member and filament segments with exposed portions for forming anchoring means on said exposed portions of said filament segments prior to the immersion of said exposed portions in said liquid anchoring material.

21. The apparatus of claim 20 wherein said anchor forming means creates surface irregularities on said exposed portions of said filament segments to facilitate the securing of said filament segments in said anchoring material.

22. The apparatus of claim 13 further comprising:

strip segmenting means in communication with said channel means for receiving said strip of brush-like material, said strip segmenting means including cutting means for segmenting said strip into predetermined lengths.

23. The apparatus of claim 22 further comprising:

gathering and securing means in communication with said strip segmenting means for receiving said segmented strips of brush-like material, gathering said strips and securing said strips into larger mats of brush-like material.

24. The apparatus of claim 13 wherein said cutting means and said opening means cuts said wound filament and opens said tubular member into a plurality of strips holding said filament segments.

* * * * *

UNITED STATES PATENT AND TRADEMARK OFFICE

CERTIFICATE OF CORRECTION

PATENT NO. : 4,498,708

DATED : February 12, 1985

INVENTOR(S) : Jonathan J. Bromboz

It is certified that error appears in the above—identified patent and that said Letters Patent is hereby corrected as shown below:

Column 3, line 26 delete "the";

Column 5, line 3 delete "would", insert --wound--;

Column 5, line 16 delete "severes", insert --severs--;

Column 6, line 31 delete "a", insert --as--.

Signed and Sealed this

*Twenty-seventh* Day of *August 1985*

[SEAL]

*Attest:*

DONALD J. QUIGG

*Attesting Officer* *Acting Commissioner of Patents and Trademarks*